US005099651A

United States Patent [19]

Fischer

[11] Patent Number: 5,099,651

[45] Date of Patent: Mar. 31, 1992

[54] GAS ENGINE DRIVEN HEAT PUMP METHOD

[75] Inventor: Robert D. Fischer, Columbus, Ohio

[73] Assignee: Gas Research Institute, Chicago, Ill.

[21] Appl. No.: 652,015

[22] Filed: Feb. 7, 1991

Related U.S. Application Data

[62] Division of Ser. No. 402,660, Sep. 5, 1989, Pat. No. 5,003,788.

[51] Int. Cl.[5] ..... F25B 7/00

[52] U.S. Cl. ..... 62/79; 62/238.7; 62/160; 62/80; 62/323.1

[58] Field of Search ..... 62/238.6, 238.7, 238.5, 62/79, 160, 323.1, 80, 81; 165/141; 237/2 B

[56] References Cited

U.S. PATENT DOCUMENTS 3,466,888 9/1969 Kyle ..... 62/160 X

FOREIGN PATENT DOCUMENTS 0161437 10/1982 Japan ..... 62/238.7

*Primary Examiner*—Albert J. Makay
*Assistant Examiner*—John Sollecito
*Attorney, Agent, or Firm*—Watkins, Dunbar & Pollick

[57] ABSTRACT

A heat pump system selectively operable in cooling and heating modes of operation and having an internal combustion engine prime mover which produces refrigerant vapor compression, and which produces excess heat for rejection, is provided with a first heat exchanger that evaporates compressed refrigerant in the system heating mode of operation, with a second heat exchanger which uses prime mover rejected heat to heat a working fluid, and with a fluid distribution arrangement which is selectively operable to flow the heated working fluid in heat exchange relation to said first heat exchanger also, in the system heating mode of operation to provide a defrost capabilities and to improve heat pumping heating capacity at low ambient temperatures.

6 Claims, 3 Drawing Sheets

GAS ENGINE DRIVEN HEAT PUMP METHOD

REFERENCE

This application is a division of co-pending U.S. Patent Application Ser. No. 07/402660, Filed Sept. 5, 1989 now U.S. Pat. No. 5,003,788 having the same title.

TECHNICAL FIELD OF THE INVENTION

This invention relates to a method of operating heat pump systems of the gas engine driven, and refrigeration vapor compression type. More particularly it relates to a heat pump system which is preferably driven by a gas-fueled internal combustion engine that is at least partially cooled by a working fluid which is in fluid connection with the load and an ambient heat source or sink.

BACKGROUND OF THE INVENTION

This disclosure is directed primarily to heat pump systems which are applied to heating and air-conditioning loads of the environment in living spaces of buildings. As used herein the term air-conditioning means the adjustment of the temperature and humidity in the living space to selected comfortable norms when the outside environment, and particularly the ambient temperature, is either too high or too low for comfort. However many of the objectives and concepts of this invention also have application to other types of thermal loads. Therefore the term load as used herein while specifically in the context of air-conditioning, may be interpreted broadly to apply to other thermal loads by those familiar with heating and cooling technology.

It is well recognized that air-conditioning and heat pumping thermal systems require a fluid source to which the heat load may be transferred in the cooling mode and from which the heat may be transferred in the heating mode. In recent times and particularly in connection with air-conditioning activity, efforts have been directed to the convenient economical use of ambient outside air as the heat sink for the cooling load, and as the heat source in the heating or heat pumping mode.

When outside ambient air is used as a heat source in the heat pumping mode, and the ambient air is at low temperature, i.e., near, at, or below the freezing temperature of the moisture in the air, the problem of frozen condensate on the outdoor refrigerant heat exchanger is a serious one. As the moisture collects on the outside heat exchanger and builds up in the form of frost it acts as an insulator and reduces the heat exchange conductivity of the outdoor heat exchanger surfaces. With the reduction in conductivity there is the consequential reduction in thermal efficiency so that heat pumping effectiveness is drastically reduced.

This problem of frosting on the outdoor refrigerant coil, which is operating as an evaporator in the heat pumping mode, is well known and various means are provided in typical prior art systems to treat and overcome the problem. In most instances, the method of meeting this problem is to temporarily interrupt the heat pumping cycle long enough to reheat and defrost the surfaces of the heat exchanger. This is often done by the application of intense heat in the form of electrical resistance heaters and/or reversing the cycle to the heating mode so that the outdoor heat exchanger operates as a condenser for a short period of time. This solution to the problem reduces the overall coefficient of performance of the unit, since the use of input energy for other than heating the indoor space is counterproductive for the period when defrosting is taking place.

It has been recognized that when an internal combustion engine or other hydrocarbon burning prime mover is used to drive the compressor of a refrigerant vapor air-conditioning and heat pump system, all of the heat of burning the fuel is not used or applied to creating the motive power. The rejected energy in the form of heat is available for other purposes; one known use is to make domestic hot water.

U.S. Pat. No. 4,697,434 Yayama discloses an air-conditioning and hot water supplying system capable of recovering heat discharged from the prime mover for utilization thereof as an auxiliary heat source for heating air as well a heat source for heating water to be stored in a hot water tank. In this patent, engine cooling fluid flows through a heat exchanger where it is selectively directed to heating hot water and/or boosting the thermal efficiency of the system by heat exchange with the refrigerant fluid.

Other patents in the prior art find other related uses and show the efforts made to take advantage of the "waste" engine heat.

U.S. Pat. No. 4,510,762 Richarts shows a heat recovery method of general interest.

U.S. Pat. No. 3,799,243 Castillo relates to liquid vapor cycle air conditioning systems of the reversible or heat pump type, i. e., systems which are capable of operating in both a heating and cooling mode. Waste heat from combustion is used in the process.

U.S. Pat. No. 3,421,339 Volk et al. shows an unidirectional heat pump system. Heat from the engine cooling is used in the heating cycle evaporator.

U.S. Pat. No. 3,135,318 Carleton reveals a heat pump system which has a turbine engine as its prime mover and makes use of the heat content of the exhaust of such engine so as to increase the efficiency of the system during both heating and cooling. The patent is of general interest to the concept of using waste heat in heat pumps.

These patents, while recognizing the advantages of using the waste heat, do not apply this heat to the outdoor heat exchanger in a total system including all of the components found in various teachings and constructions for gas-fueled engine driven refrigerant vapor fluid compressor heat pumping systems that include heating for utility hot water.

SUMMARY OF THE INVENTION

The present invention relates to a method and apparatus for applying the waste heat from the cooling fluid and/or exhaust sound muffling means on the engine in and to an outdoor heat exchanger in a heating and cooling air-conditioning system powered by a gas fueled engine driving a refrigerant vapor fluid compressor. The system is arranged with selectively reversible fluid connections between components of a first outdoor heat exchanger and a first indoor heat exchanger, wherein the system includes a subsystem having a working fluid in selectively reversible fluid connection between components of a second outdoor heat exchanger and a second indoor heat exchanger with the working fluid in additional fluid connections and heat exchange relationship with the cooling means and the exhaust means of the engine, for the purpose of improving heat pumping during system operation and improving defrosting during low ambient air operating conditions.

The foregoing and other advantages of the invention will become apparent from the following disclosure in which the preferred embodiment of the invention is described in detail and illustrated in the accompanying drawings. It is contemplated that variations and procedure, structural features and arrangement of parts may appear to those skilled in the art without departing from the scope or sacrificing any of the advantages of the invention.

Figure 1:
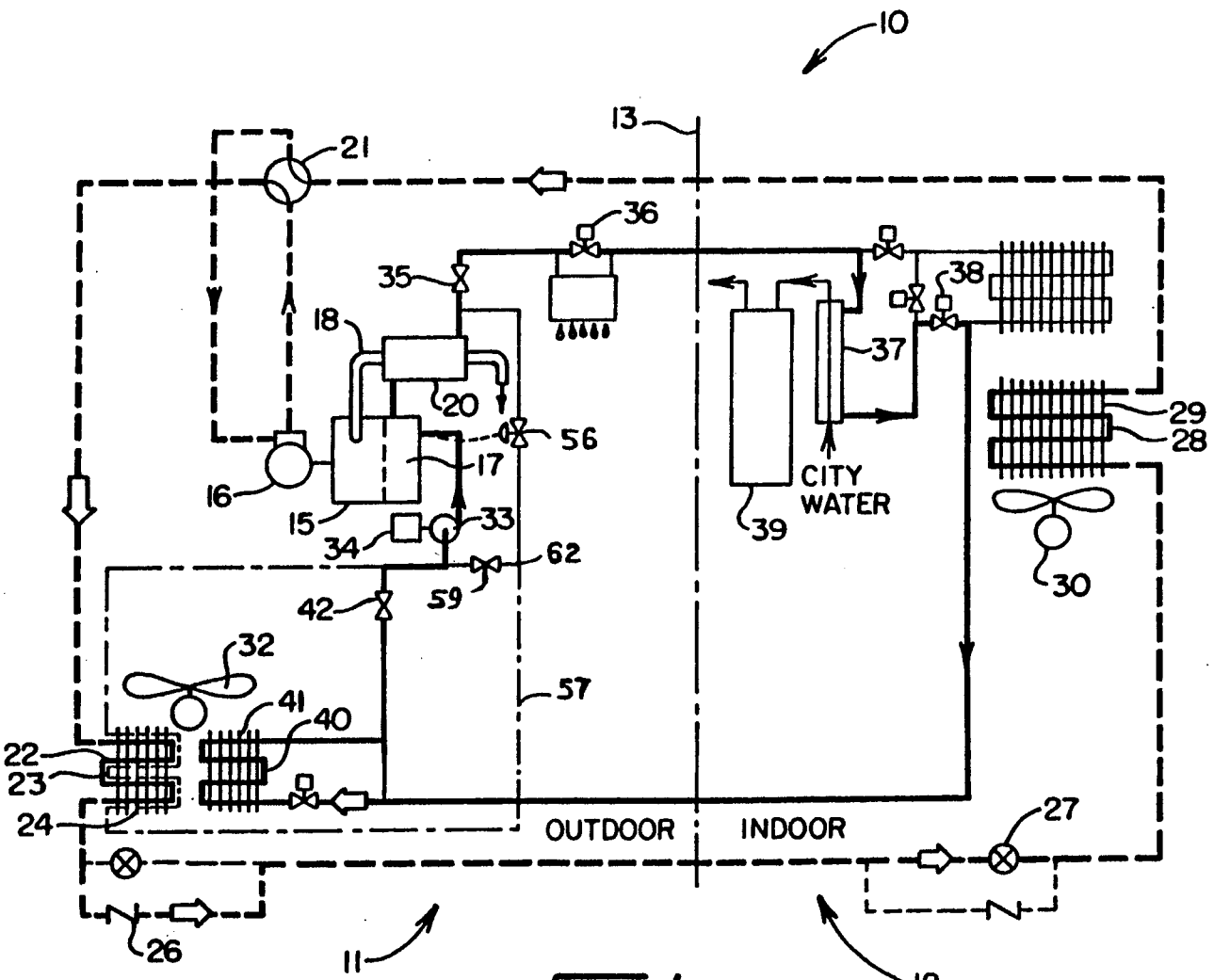
FIG. 1 is a schematic diagram of the heat pump system of this invention in which the method of the invention is practiced. The system has been selectively arranged for operation in the cooling mode.

In the following description of the preferred embodiment of the invention, which is illustrated in the drawings, specific terminology will be used for the sake of clarity. However, it is not intended that the invention be limited to the specific terms so selected or the system so shown and it is to be understood that each specific term includes all technical equivalents which operate in a similar manner to accomplish a similar purpose.

DETAILED DESCRIPTION OF A PREFERRED EMBODIMENT OF THE INVENTION IN THE BEST MODE

Figure 2:
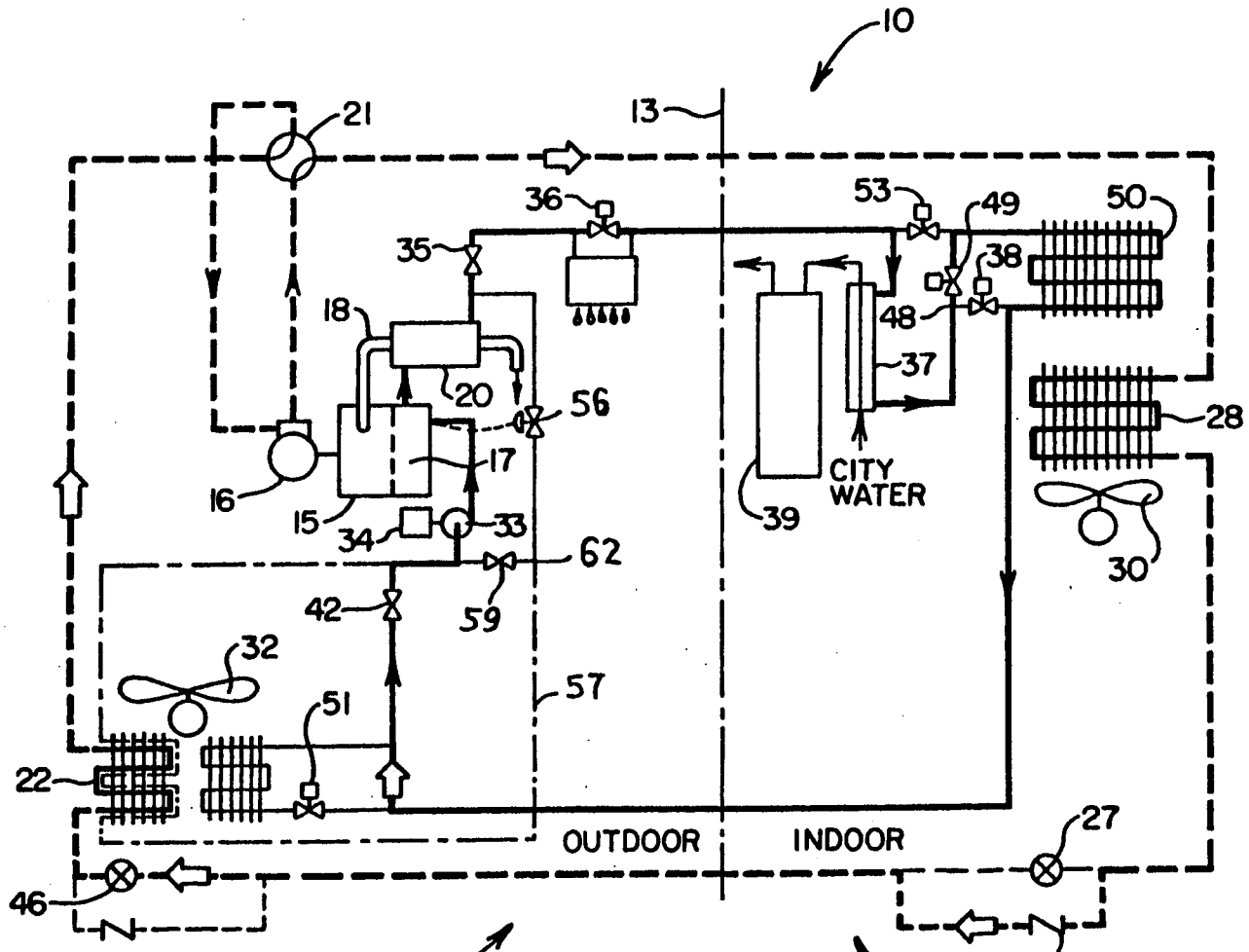
FIG. 2 is a schematic view of the system of this invention in the heating mode with the components selectively arranged for high ambient outdoor air temperature conditions.
Figure 3:
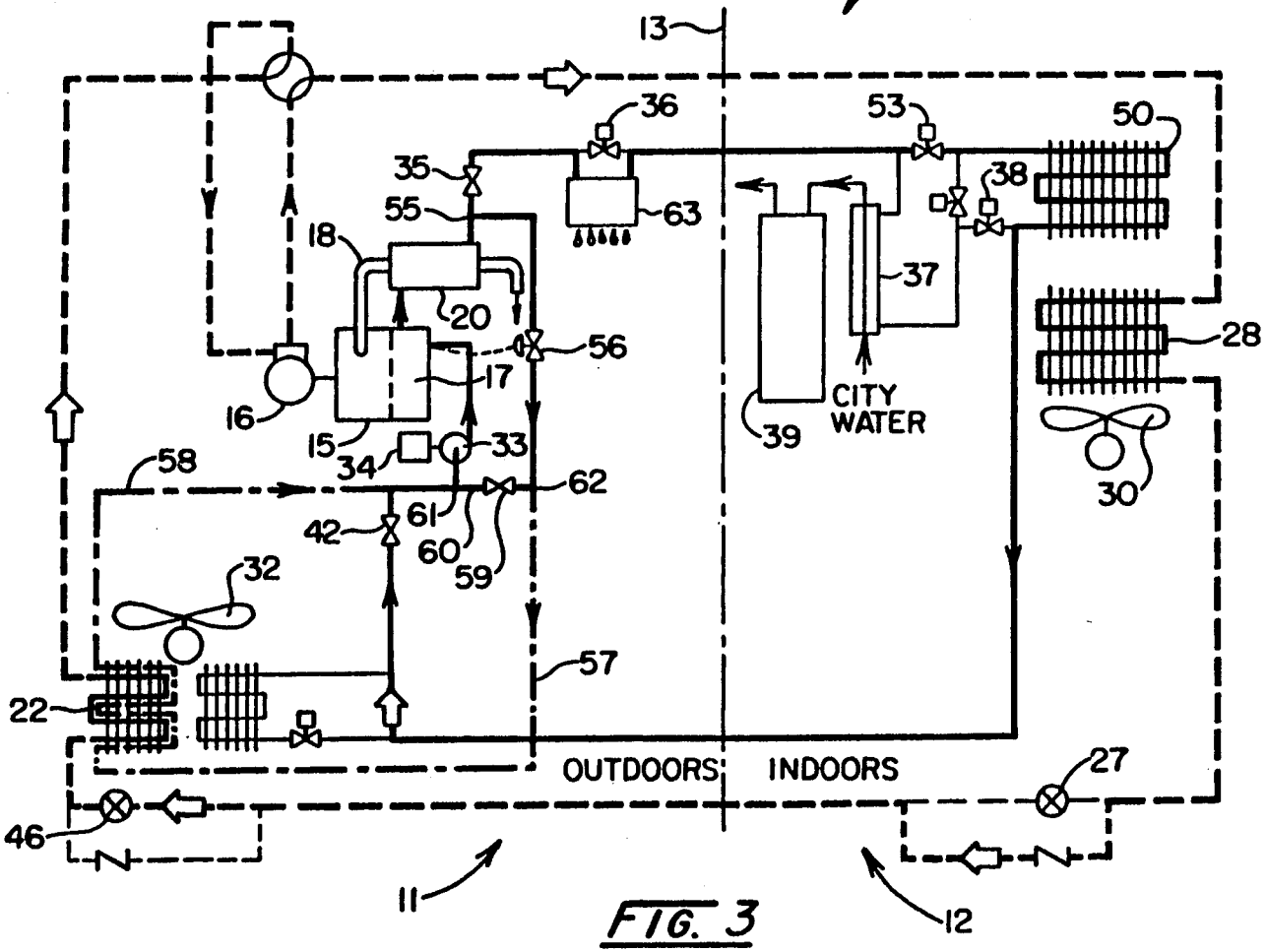
FIG. 3 is a schematic view of the system of this invention with the components selectively arranged for operation in the heating mode with low ambient outdoor air temperature conditions.

Referring to FIGS. 1, 2 and 3, the system, referred to generally as 10 includes an outdoor portion 11 and an indoor portion 12, those components being schematically divided by the line 13.

Cooling Mode

In FIG. 1, the system is shown with the components selectively arranged for operation in the cooling mode, and includes an internal combustion engine 15 mechanically connected to a refrigerant vapor compressor 16. The engine 15 includes a cooling fluid jacket 17 and an exhaust pipe means 18 which flows engine combustion exhaust gases to a heat exchanger and/or muffler means 20.

In the heat pump system, compressed refrigerant vapor is conveyed through a reversing valve 21 which is set to convey the vapor to an outdoor heat exchanger 22 (a first heat exchanger) which functions as a condenser in the system cooling mode. Conduits 23 through the heat exchanger 22 are in conductive connection to fins 24. The cooled vapor (which may be all or part liquid) is conveyed through a check valve 26 from the outdoors to the indoors, where the vapor passes through an expansion valve 27. The refrigerant vapor passes through an indoor heat exchanger 28 having fins 29 over which air from living space of the building air is flowed by an air distribution subsystem blower 30. The air flowed by blower 30 is primarily return air from the air-conditioned space and in the cooling mode represents the load on the system. Some of the air may be fresh air obtained from outside the conditioned space in minor amounts. The warmed vapor returns from the heat exchanger 28 to the compressor 16 by way of the reversing valve 21 which is set to bring the vapor back to the compressor.

A fan 32 conveys the outside ambient air across the heat exchanger 22 to facilitate the heat exchange between the refrigerant vapor and the outside ambient air which is a heat sink in the cooling mode of operation.

The engine 15 with its coolant jacket 17 (a second heat exchanger) are part of a working fluid subsystem which operates to utilize a portion of the heat generated by the engine and not utilized in driving the compressor 16. This heat energy is conveyed to the working fluid by circulation through the jacket 17 and the recuperator heat exchanger 20 (thermally a part of the second heat exchanger). The working fluid is preferably a mixture of salt (brine) or glycol with water to provide a liquid capable of being reduced in temperature well below the operating temperatures in the ambient air of the outside heat exchanger 22.

The working fluid subsystem includes a pump 33, which may be driven by an electric motor 34. Alternatively, the pump 33, may be driven by the engine 15. The pump 33 is in fluid connection with the engine cooling jacket 17. From the engine jacket 17, the working fluid is conveyed through the recuperator 20, through a cutoff valve 35, and through an open cutoff valve 36 to a utility hot water heat exchanger 37. From the heat exchanger 37, working fluid is conveyed through open cutoff valve 38 and 51 to an outdoor working fluid heat exchanger 40 (a third heat exchanger or radiator), having fins 41, which is positioned in the outside air flow pattern of air induced by the fan 32. From the heat exchanger 40 the working fluid is conveyed through the valve 42 back to the pump 33. Valves 56 and 59 are closed in the cooling mode and no working fluid flows in circuit 57. Heat from the refrigerant is conducted through the working fluid to the fins 24 and the ambient air. Utility hot water is conveyed from the heat exchanger 37 to a storage tank 39 where it may be used as necessary for domestic or other hot water purposes.

The operation of the system in the cooling mode is according to a typical vapor compression refrigerant vapor cooling cycle wherein the vapor is compressed in compressor 16, condensed in heat exchanger 22, conveyed as a liquid to expansion valve 27 and expanded into the evaporator 28 before being returned to the compressor 16. The excess or waste heat from the engine is transferred to the working fluid which circulates through the utility hot water heat exchanger 37 providing utility hot water as needed and through the heat exchanger 40 to reach an appropriate temperature to provide cooling to the engine and maintain its proper operating temperature.

Warm Ambient Heating Mode

FIG. 2 shows the system 10 arranged for heating mode operation when the outside ambient temperature is above the freezing point of the water vapor in the air but less than comfortable for direct circulation in the living space.

A typical temperature range for this type of high ambient heating operation is between about 25° F. and 60° F. The lowest outdoors ambient temperature is that temperature at which the capacity of heat pumping from out air is reduced to the extent that auxiliary heat input by the boiler is required. It is well known that the capacity of heat pumping falls off as the outdoor temperature decreases due to the change in density of the refrigerant.

In this mode, refrigerant vapor from the compressor 16 is conveyed through the reversing valve 21, which has been reversed, and selectively arranged to convey the refrigerant vapor to the heat exchanger 28 (which is operating as a condenser) to be cooled by the indoor air being recirculated by the fan 30. The cooled liquid refrigerant is afterwards conveyed to and through a check valve 45, and then stopped off by the closed expansion valve 27. The liquid refrigerant expands through a expansion valve 46 into the outdoor heat exchanger 22 (which is operating as an evaporator). From the heat exchanger 22 refrigerant vapor returns to the compressor through the reversing valve 21.

In this warm ambient heating mode, the working fluid circulates, as previously described for the cooling mode, to the cutoff valve 38 which has been selectively arranged in the closed position, past a connection point 48. A second alternative cutoff valve 49 has been selectively arranged in the open position and the working fluid is conveyed through an indoor heat exchanger 50 before returning to the pump 33 by way of connections through valve 42. A shut off valve 53 is selectively closed in order to supply the working fluid to the utility hot water heat exchanger 37. Another shut off valve 51 prevents flow through the outdoor heat exchanger 40 in this mode of operation. In this mode of operation, the heat pump system is operating in the typical refrigerant vapor reversed compression cycle while the heat for the indoor air is augmented by circulation of the working fluid through the indoor heat exchanger 50. By this means the heat from cooling the engine which might otherwise be wasted is transferred to the air conditioning heating mode regaining some of the lost energy not transferred to the compressor by the operation of the engine.

Low Ambient Heating and Defrosting Mode

Referring to FIG. 3, when the outside ambient air temperature is below about 25° F. or when defrosting of heat exchanger 22 is required, and the system is operating in the heating mode, the system is selectively arranged to circulate working fluid from a connection point 55 through a thermostatically controlled valve 56 that is responsive o the inlet temperature of the engine jacket 17 "first heat exchanger" and a conduit 57 into conductive heat exchange relationship with the refrigerant vapor in the outdoor heat exchanger 22. From the heat exchanger 22, the working fluid returns to the pump 33 by means of a conduit 58. A modulating valve 59 is provided in a conduit 60 that is connected between the connection points 61 and 62 in the circuit 57, 58.

In the extreme low ambient heating mode condition, it may be necessary and convenient to circulate the working fluid through a boiler 63 by closing the shutoff valve 36 and providing auxiliary heat directly to the heating space through the indoor working heat exchanger 50.

The valve 35 is used to modulate and control the amount of working fluid flowing to the auxiliary source of heat (boiler 63) and the indoor working fluid heat exchanger 50. By means of valve 35 in conjunction with a thermostatic valve 56, and the selective modulation of the valves 59 and 42, the amount of heat from the engine is optimally applied to the outdoor heat exchanger 22 from the working fluid subsystem. By these means, all or substantially all of the engine heat may be applied to the outdoor heat exchanger coil 22 providing for rapid defrosting or controlled defrosting if necessary. By these same means, at outdoor temperatures below about 25° F. where heat pumping has fallen to the extent that auxiliary heat at the boiler is required, the heat source at the heat exchanger 22 can be shifted from outside air to the engine coolant working fluid. The fan 32 may be selectively controlled through speed adjustments even to a stopped condition to further enhance the heating effect of the engine heat being applied to the heat exchanger coil 22.

It will be seen, that by the selective arrangement of the valves controlling the working fluid in conduits 57 and 58 and the selective arrangement of the valves 36 and 38, the system may be operated at maximum efficiency to use the heat energy obtained in cooling the engine, and which what might otherwise be wasted, to obtain the highest coefficient performance for the total system.

Figure 4:
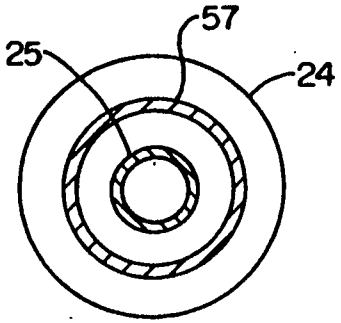
FIG. 4 is a cross-sectional view of a tube-in-tube heat exchanger that would be a preferred embodiment for an outdoor three fluid heat exchanger construction as shown schematically in FIG. 3.

Referring to FIG. 4, conduit 57 is of tubular form with the first heat exchanger 22 and contains conduit 25 through which the refrigerant vapor passes. The coolant working fluid passes through the annulus between conduits 25 and 57. When this fluid flow is stopped circuit 57 is inactive. The coolant working fluid in the annulus acts as an efficient medium for intimately conducting heat from conduit 25 to conduit 57. A plurality of fins 24 circumscribe the conduit 57. It is believed that this type of tube-in-tube construction is the most advantageous and efficient heat exchange embodiment of the heat exchange unit 22.

Although a preferred embodiment of the invention has been herein described, it will be understood that various changes and modifications in the illustrated described structure can be effected without departure from the basic principles that underlie the invention. Changes and modifications of this type are therefore deemed to be circumscribed by the spirit and scope of the invention defined by the appended claims or by a reasonable equivalence thereof.

I claim:

1. In a method of operating a heat pump system selectively operable in cooling and heating modes of operation by reversing a refrigerant vapor compression system by means of selectively positionable and reversible valves, and having a internal combustion prime mover to drive a compressor which produces the compression of refrigerant vapor, and which prime mover produces excess heat for rejection, the combined steps of:

a. placing the system in the heating mode of operation by selective positioning of said valves, and receiving and evaporating a flow of compressed refrigerant in an evaporator heat exchanger means immersed in an ambient atmosphere and b. modulating the flow of engine reject heat in intimate conductive heat exchange with the refrigerant within the evaporator heat exchanger as necessary to prevent frost on the surfaces of the evaporator heat exchanger, while simultaneously modulating the flow of the ambient atmosphere across said evaporator heat exchanger in selective proportion to that required on the surfaces of the heat exchanger to prevent the formation of frost on said surfaces.

2. The method defined by claim 1 wherein said engine prime mover reject heat is selectively flowed to a second heat exchanger means in preference to flow to said evaporator heat exchanger means, said engine prime mover reject heat being flowed to said second heat exchanger means when the system is operated in its heating mode of operation and when said ambient atmosphere does not produce frost under the selected conditions of operation of the system.

3. The method defined by claim 2 wherein said second heat exchanger means is in the indoor air flow stream of an air conditioned space.

4. The method defined by claim 2 wherein the prime mover reject heat is flowed by means of a heat conducting working fluid passing through said first and second heat exchanger means.

5. The method defined by claim 4 wherein an auxiliary boiler having direct heat input means is connected between the prime mover and the second heat exchanger and the input to the boiler is activated when necessary to prevent formation of frost on the surfaces of the first heat exchanger.

6. The method defined by claim 2 wherein the working fluid is selectively flowed through a fourth heat exchanger for heating domestic hot water for use by residents in the air conditioned space.

* * * * *